US006281635B1

(12) United States Patent
Lee

(10) Patent No.: US 6,281,635 B1
(45) Date of Patent: Aug. 28, 2001

(54) SEPARATE VOLTAGE DRIVING METHOD AND APPARATUS FOR PLASMA DISPLAY PANEL

(75) Inventor: Eung Kwan Lee, Daeku-shi (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/593,148

(22) Filed: Jun. 14, 2000

(30) Foreign Application Priority Data

Jun. 15, 1999 (KR) ..... 99-22271

(51) Int. Cl.[7] ..... G09G 3/10

(52) U.S. Cl. ..... 315/169.4; 315/169.1; 345/60; 345/211

(58) Field of Search ..... 315/169.4, 169.1; 313/581; 345/41, 42, 60, 67, 208, 211, 212, 213, 214

(56) References Cited

U.S. PATENT DOCUMENTS 5,331,252 * 7/1994 Kim ..... 315/169.4
5,332,949 * 7/1994 Kim ..... 315/169.1
5,828,353 * 11/1998 Kishi et al. ..... 345/60
5,872,425 * 2/1999 Shino et al. ..... 313/582
5,982,344 * 11/1999 Tokunaga ..... 345/208
6,002,381 * 12/1999 Tomio et al. ..... 345/67
6,018,329 * 1/2000 Kida et al. ..... 345/60
6,088,010 * 7/2000 Makino et al. ..... 345/60
6,107,978 * 8/2000 Nagaoka et al. ..... 315/169.4
6,144,348 * 11/2000 Kanazawa et al. ..... 315/169.1
6,195,075 * 2/2001 Shino et al. ..... 345/60
6,198,463 * 3/2001 Ito et al. ..... 345/60

* cited by examiner

*Primary Examiner*—Don Wong
*Assistant Examiner*—Thuy Vinh Tran
(74) *Attorney, Agent, or Firm*—Fleshner & Kim, LLP

(57) ABSTRACT

A separate voltage driving apparatus for a plasma display panel that is capable of restraining an abnormal brightness caused by a characteristic deviation of the panel as well as preventing a damage of switching devices caused by an overcurrent. Any one of sustaining drivers of the apparatus can include a writing voltage generator, a sustaining voltage generator that generates pulses, each of which has a voltage level and a pulse width required for sustaining the writing discharge of the entire cells between the first and second electrodes, having a phase contrary to and being synchronized with each other, and an erasure scanning voltage generator. A voltage driving apparatus can further include a voltage recovering stage and a voltage input/output stage.

14 Claims, 7 Drawing Sheets

SEPARATE VOLTAGE DRIVING METHOD AND APPARATUS FOR PLASMA DISPLAY PANEL

BACKGROUND OF THE INVENTION

1. Field of the Invention

This invention relates to a method and apparatus for separately driving a voltage in a plasma display panel, and more particularly to a separate voltage driving method and apparatus for a plasma display panel wherein abnormal brightness caused by a characteristic deviation of the panel is not only restrained, but also a damage of a switching device caused by an overcurrent is prevented. Also, the present invention is directed to a separate voltage driving method and apparatus for a plasma display panel wherein a sustaining voltage, a writing voltage and an erasing voltage are separated and adjusted in accordance with a characteristic deviation of the panel.

2. Description of the Related Art

Generally, a plasma display panel (PDP) radiates a fluorescent body by an ultraviolet with a wavelength of 147 nm generated during a discharge of He+Xe or Ne+Xe gas to thereby display a picture including characters and graphics. Such a PDP is easy to be made into a thin film and large-dimension type. Moreover, the PDP provides a very improved picture quality owing to a recent technical development. The PDP is largely classified into a direct current (DC) driving system and an alternating current (AC) driving system.

Since the AC-type PDP has an advantage of a low voltage driving and a long life in comparison to the DC-type PDP, it will be highlighted as the future display device. The AC-type PDP allows an alternating voltage signal to be applied between electrodes having dielectric layer therebetween to generate a discharge every half-period of the signal, thereby displaying a picture. Since such an AC-type PDP uses a dielectric material that allows a wall charge to be accumulated on the surface thereof upon discharge, it exerts a memory effect.

Referring to FIG. 1 and FIG. 2, the AC-type PDP includes a front substrate 1 provided with a sustaining electrode pair 10, and a rear substrate 2 provided with address electrodes 4. The front substrate 1 and the rear substrate 2 are spaced in parallel to each other with having barrier ribs 3 therebetween. A mixture gas, such as Ne—Xe or He—Xe, etc., is injected into a discharge space defined by the front substrate 1, the rear substrate 2 and the barrier ribs 3. These sustaining electrodes 10 make a pair by two within a single of plasma discharge channel. Any one electrode of the sustaining electrode pair 10 is used as a scanning/sustaining electrode that responds to a scanning pulse applied in an address interval to cause an opposite discharge along with the address electrode 4 while responding to a sustaining pulse applied in a sustaining interval to cause a surface discharge with the adjacent sustaining electrodes 10. Also, the sustaining electrode 10 adjacent to the sustaining electrode 10 used as the scanning/sustaining electrode is used as a common sustaining electrode to which a sustaining pulse is applied commonly. On the front substrate 1 provided with the sustaining electrodes 10, a dielectric layer 8 and a protective layer 9 are disposed. The dielectric layer 8 is responsible for limiting a plasma discharge current as well as accumulating a wall charge during the discharge. The protective film 9 prevents a damage of the dielectric layer 8 caused by the sputtering generated during the plasma discharge and improves the emission efficiency of secondary electrons. This protective film 9 is usually made from MgO. The rear substrate 2 is provided with a dielectric thick film 6 covering the address electrodes 4. The barrier ribs 3 for dividing the discharge space are extended perpendicularly at the rear substrate 2. On the surfaces of the rear substrate 2 and the barrier ribs 3, a fluorescent material 5 excited by a vacuum ultraviolet lay to generate a visible light is provided.

As shown in FIG. 3, the PDP 21 has mxn discharge pixel cells 11 arranged in a matrix pattern. At each of the discharge pixel cells 11, scanning/sustaining electrode lines Y1 to Ym, hereinafter referred to as "Y electrode lines", and common sustaining electrode lines Z1 to Zm, hereinafter referred to as "Z electrode lines", and address electrode lines X1 to Xn, hereinafter referred to as "X electrode lines" are crossed with respect to each other. The Y electrode lines Y1 to Ym and the Z electrode lines Z1 to Zm consist of the sustaining electrode 10 making a pair. The X electrode lines X1 to Xn consist of the address electrode 4.

FIG. 3 is a schematic view of a PDP driver shown in FIG. 1. In FIG. 3, the PDP driver includes a scanning/sustaining driver 22 for driving the Y electrode lines Y1 to Ym, a common sustaining driver 24 for driving the Z electrode lines Z1 to Zm, and first and second address drivers 26A and 26B for driving the X electrode lines X1 to Xn. The scanning/sustaining driver 22 is connected to the Y electrode lines Y1 to Ym to thereby select a scanning line and cause a sustaining discharge at the selected scanning line. The common sustaining driver 24 is commonly connected to the Z electrode lines Z1 to Zm to apply sustaining pulses with same waveform to all the Z electrode lines Z1 to Zm, thereby causing the sustaining discharge. The first address driver 26A supplies odd-numbered X electrode lines X1, X3, . . . , Xn-3, Xn-1 with a video data, whereas the second address driver 26B supplies even-numbered X electrode lines X2, X4, . . . , Xn-2, Xn with a video data.

In such an AC-type PDP, one frame consists of a number of sub-fields so as to realize gray levels by a combination of the sub-fields. For instance, when it is intended to realize 256 gray levels, one frame interval is time-divided into 8 sub-fields. Further, each of the 8 sub-fields is again divided into a reset interval, an address interval and a sustaining interval. The entire field is initialized in the reset interval. The cells on which a data is to be displayed are selected by a writing discharge in the address interval. The selected cells sustain the discharge in the sustaining interval. The sustaining interval is lengthened by an interval corresponding to $2^n$ depending on a weighting value of each sub-field. In other words, the sustaining interval involved in each of first to eighth sub-fields increases at a ratio of $2^0$, $2^1$, $2^3$, $2^4$, $2^5$, $2^6$ and $2^7$. To this end, the number of sustaining pulses generated in the sustaining interval also increases into $2^0$, $2^1$, $2^3$, $2^4$, $2^5$, $2^6$ and $2^7$. depending on the sub-fields. The brightness and the chrominance of a displayed image are determined in accordance with a combination of the sub-fields.

FIG. 4 is a detailed circuit diagram of the scanning/sustaining driver shown in FIG. 3. In FIG. 4, the scanning/sustaining driver 22 includes a voltage input/output stage 22*a*, a writing/erasure scanning voltage generator 22*b*, a sustaining voltage generator 22*c* and a voltage recovery stage 22*d* so as to apply a driving pulse to any one of m Y electrode lines Y1 to Ym. The voltage input/output stage 22*a* consists of first and second switching devices Q1 and Q2 connected, in series, to each other, and diodes D1 and D2 connected, in parallel, to the first and second switching devices Q1 and Q2, respectively. The first and second switching devices Q1 and Q2 are selectively switched in response to a control signal applied from a controller (not shown). Thus, the first and second switching devices Q1 and Q2 applies a writing/erasure scanning pulse voltage Vp and a sustaining voltage VH to a pixel cell 11 of the panel 20. The sustaining voltage generator 22*c* consists of third and fourth switching devices Q3 and Q4 connected, in series, between a sustaining voltage (VH) supply terminal and a ground terminal GND, and fifth and sixth switching devices Q5 and Q6 and diodes D3 and D4 connected to a middle voltage VM having a half level of the sustaining voltage VH to make a closed loop. The third and fourth switching devices Q3 and Q4 are selectively switched in response to a control signal applied from the controller. If the switching device Q3 is turned on, then the sustaining voltage VH is applied, via the diode D2 included in the voltage input/output stage 22*a*, to the panel 20. On the other hand, if the switching device Q4 is turned on, then a voltage having been charged in the panel 20 is coupled with the ground terminal GND. The fifth and sixth switching devices Q5 and Q6 respond to a control signal applied from the controller to apply the middle voltage VM to the panel 20. The writing/erasure scanning voltage generator 22*b* a writing/erasure scanning voltage VP into the capacitor C1 when the fourth switch Q4 of the sustaining voltage generator 22*c* has been turned on. The writing/erasure scanning voltage generator 22*b* applies a voltage charged in the capacitor C1 to the panel 20 when the third switch Q3 of the sustaining voltage generator 22*c*. The voltage recovery stage 22*d* consists of capacitors C2 and C3 connected to a ground terminal GND, seventh and eighth switching devices Q7 and Q8 and diodes D5 and D6 connected to a second capacitor C2 to make a closed loop, and ninth and tenth switching devices Q9 and Q10 and diodes D7 and D8 to make a closed loop. If the eighth and tenth switching devices Q8 and Q10 are turned on, then an invalid power at the panel 20 is recovered. The recovered invalid power is accumulated at a different voltage level in the capacitors C2 and C3. If the seventh and ninth switching devices Q7 and Q9 are turned on, then the voltage accumulated in the capacitors C2 and C3 is applied to the panel 20. The voltage input/output stage 22*a*, the writing/erasure scanning voltage generator 22*b*, the sustaining voltage generator 22*c* and the voltage recovery stage 22*d* installed at the common sustaining driver 24 are symmetrically arranged around the panel 20.

An operation process of the scanning/sustaining driver 22 will be described in detail with reference to FIG. 5, in which (a) shows a waveform applied to the X electrode lines; (b) shows a waveform applied to the Y electrode lines; (c) shows a waveform applied to the Z electrode lines; and (d) to (k) represent switching timings for producing waveforms of (b) and (c). First, in the sustaining discharge interval of the previous sub-field, a high pulse having a certain period as shown in (f) and (g) of FIG. 5 is applied from the controller to gate terminals G5 and G6 of the fifth and sixth switching devices Q5 and Q6. If the fifth and sixth switching devices Q5 and Q6 are turned on, then a middle voltage VM is applied, via the fifth switching device Q5, the third diode D3 and the second diode D2, to the panel 20. In other words, the Y electrode line Y is coupled with a middle voltage VM as shown in (b) of FIG. 5. The middle voltage VM applied from the common sustaining driver 24 to the Z electrode line Z is applied to the second switching device Q2, the fourth diode D4 and the sixth switching device Q6. In other words, if the sixth switching device Q6 is turned on, then a level of a voltage applied to the Z electrode line Z remains at the middle voltage VM accurately as shown in (c) of FIG. 5. After the middle voltage VM was applied to the Y electrode line Y and the Z electrode line Z for a desired time, a high pulse with a desired period T5 as shown in (k) of FIG. 5 is applied to the gate terminal G10 of the tenth switching device Q10. The tenth switching device Q10 is turned on in response to this high pulse. If the tenth switching device Q10 is turned on, then an invalid power is recovered from a panel capacitor formed equivalently by the Z electrode line Z and the Y electrode line Y. In other words, electric charges of the middle voltage VM accumulated in the panel capacitor for a desired period T5 when the tenth switching device Q10 is turned on, are accumulated, via the second switching device Q2, a reactor L1, an eighth diode D8 and the tenth switching device Q10, into the capacitor C3. At this time, a half level of the middle voltage VM, that is, a voltage of Vm/2 is accumulated in the capacitor C3. The voltage accumulated in the capacitor C3 is discharged in the sustaining interval of the next middle voltage VM. After a voltage of 2/VM was accumulated in the capacitor C3, the fifth and sixth switching devices Q5 and Q6 are turned off and, at the same time, a high pulse with a desired period T1 as shown in (e) of FIG. 5 is applied to the gate terminal G4 of the fourth switching device Q4. The fourth switching device Q4 is turned on in response to this high pulse. If the fourth switching device Q4 is turned on, then the Y electrode line Y is connected to the ground terminal GND. Thus, a sustaining pulse VP less than the middle voltage, that is, with a negative voltage and a writing pulse WP with a writing potential are obtained at the Y electrode line Y. On the other hand, a writing or erasure scanning voltage VP is accumulated in the capacitor C1 of the writing/erasure scanning voltage generator 22*b* when the fourth switching device Q4 is turned on. The VP is used as a voltage of the writing pulse WP and the erasure scanning pulse ESP.

A process of applying the writing pulse WP to the Y electrode line Y will be described including the scanning/sustaining driver 24 below. When the fourth switching device Q4 is turned on, the writing voltage VP accumulated in the first capacitor C1 of the scanning/sustaining driver 24 is added to the middle voltage VM and then is suddenly bypassed via the second switching device Q2 and the fourth switching device Q4. The voltage VP of the writing pulse WP plus the sustaining voltage VH less than the middle voltage, that is, with a negative voltage as shown in (b) of FIG. 5 is applied to the Y electrode line Y for a desired period T1. The voltage VP of the writing pulse WP is added to a voltage as shown in (c) of FIG. 5, which is synchronized with the sustaining pulse less than the middle voltage VM applied to the Y electrode line and the writing pulse WP and has a phase contrary to each other, that is, a positive of sustaining voltage VH, to be applied to the Z electrode line Z. When the fifth and sixth switching devices Q5 and Q6 are turned off, the third switching device Q3 and the first switching device Q1 are turned on for a desired period T1. Thus, the sustaining voltage VH is added to the writing voltage WP accumulated in the first capacitor C1 to be applied, via the first switching device Q1, to the Z electrode line Z.

As described above, if the synchronized writing pulse WP having a contrary phase as shown in (b) and (c) of FIG. 5 is applied to the Y electrode lines Y1 to Ym and the Z electrode lines Z1 to Zm, then a discharge is initiated by a voltage difference 2WP of two writing pulses WP. The pixel cells initiating the discharge in this manner make a writing discharge to be radiated. At this time, a positive(+) polarity of wall charge is formed at the Y electrode line Y while a negative(−) polarity of wall charge is formed at the Z electrode line Z.

Since such a writing discharge is influenced by the previous field state of the discharge cell, however, it becomes unstable. Accordingly, in order to make a stable discharge of all the cells, a sustaining pulse SP having a phase contrary to each other and synchronized as shown in (b) and (c) of FIG. 5 is applied.

A process of producing such a sustaining pulse SP will be described below. First, a high pulse having a desired period T4 as shown in (j) of FIG. 5 is applied to a gate terminal G9 of the ninth switching device Q9 just before the fourth switching device Q4 is turned off. The ninth switching device Q9 is turned on in response to this high pulse. If the ninth switching device Q9 is turned on, then a voltage of VM/2 having been accumulated in the third capacitor C3 is discharged. The discharged voltage is applied, via the ninth switching device Q9, the seventh diode D7, the reactor L1 and the second diode D2, to the Y electrode line Y. In other words, the Y electrode line Y maintains a sustaining voltage VH larger than the ground voltage GND as shown in (b) of FIG. 5. When the Y electrode line Y remains at the sustaining voltage VH larger than the ground voltage GND, the fourth switching device Q4 is turned off. At this time, a high pulse having a desired period T2 as shown in (f) of FIG. 5 is applied to a gate terminal G5 of the fifth switching device Q5. The fifth switching device Q5 is turned on in response to this high pulse. If the fifth switching device Q5 is turned on, then the sustaining voltage VH larger than the ground voltage GND rises during a desired period T2 to maintain the middle voltage VM. This middle voltage VM is applied, via the fifth switching device Q5, the third diode D3 and the second diode D2, to the Y electrode line Y. When the middle voltage VM is applied to the Y electrode line Y, a high pulse having a desired period T3 as shown in (h) of FIG. 5 is applied to a gate terminal G7 of the seventh switching device Q7. The seventh switching device Q7 is turned on in response to this high pulse. If the seventh switching device Q7 is turned on, then a voltage larger than the middle voltage VM accumulated in the second capacitor C2, that is, a voltage of (VH+VM)/2 is discharged. This discharge voltage is applied, via the seventh switching device Q7, the fifth diode D5, the reactor L1 and the second switching device Q2, to the Y electrode line Y. As a result, as shown in (b) of FIG. 5, a voltage of (VH+VM)/2 is applied to the Y electrode line Y for a desired period T3.

After the voltage of (VH+VM)/2 was applied to the Y electrode line Y, the fifth switching device Q5 is turned off. When the fifth switching device Q5 is turned off, a high pulse having a desired period T6 as shown in (d) of FIG. 5 is applied to a gate terminal of the third switching device Q3. The third switching device Q3 is turned on in response to this high pulse. If the third switching device Q3 is turned on, then the sustaining voltage VH is applied, via the third switching device Q3 and the second switching device Q2, to the Y electrode line Y. Thus, a sustaining pulse having a higher potential than the middle voltage VM as shown in (b) of FIG. 5, that is, a positive sustaining pulse SP is applied to the Y electrode line Y during a desired period T6. On the other hand, a sustaining pulse SP having a phase contrary to the sustaining pulse SP applied to the Y electrode line Y as shown in (c) of FIG. 5 is applied to the Z electrode line Z. The sustaining pulse SP applied to the Z electrode line Z is bypassed via the second switching device Q2 and the fourth switching device Q4. Accordingly, a negative sustaining pulse having a ground voltage GND is applied to the Z electrode line Z.

If a synchronized sustaining pulse SP having a contrary phase is applied to the Y and Z electrode lines Y and Z is applied, then an electric field forming wall charges at the panel 20 is superposed with an applying electric field. In other words, a sustaining discharge is caused by a sustaining voltage difference 2SP between two electrodes. Accordingly, a writing discharge becomes stable and wall charges are formed at a constant level. a formation position of the wall charges is changed to form a negative(−) polarity of wall charges at the Y electrode lines and to form a positive(+) polarity of wall charges at the Z electrode lines. A high pulse as shown in (i) of FIG. 5 is applied to a gate terminal G8 of the eighth switching device Q8 upon the lapse of the desired period T6, that is, prior to the shutting-off of the third switching device Q3. The eighth switching device Q8 is turned on in response to this high pulse. If the eighth switching device Q8 is turned on, then the sustaining voltage VH is accumulated, via the reactor L1 and the sixth diode D6, into the second capacitor C2 at a value of (VH+VM)/2. When the voltage is accumulated, the third switching device Q3 is turned off. When the third switching device Q3 is turned off, high pulses having desired periods T8 and T9 as shown in (f) and (g) of FIG. 5 are applied to gate terminals G5 and G6 of the fifth and sixth switching devices Q5 and Q6, respectively. The fifth and sixth switching devices Q5 and Q6 are turned on in response to these high pulses. If the fifth and sixth switching devices Q5 and Q6 are turned on, then the Y electrode line Y remains at the middle voltage VM as shown in (b) of FIG. 5. At this time, a positive address pulse as shown in (a) of FIG. 5 is applied from the address driver 26 to the X electrode line in the cells to be turned off. An erasure pulse ESP as shown in (b) of FIG. 5 is synchronized with the address pulse to be applied to the Y electrode line Y during the desired periods T8 and T9. At the cells coupled with the erasure pulse ESP and the address pulse, a minute discharge, that is, an erasing discharge is generated to terminate an emitting discharge. More specifically, a certain cell arranged in a matrix pattern can be selected by the erasure pulse ESP applied to the Y electrode line Y and the address pulse applied to the X electrode line X. At the discharge cell coupled with the erasure pulse ESP and the address pulse, an erasing discharge is generated. In other words, a wall voltage remains at a ground level to terminate an emitting discharge. The Z electrode line Z remains at the middle voltage VM in such an address interval. In other words, a discharge is not generated between the Z electrode line Z coupled with the middle voltage VM and the Y electrode line Y coupled with the erasure pulse ESP.

A process of producing the erasure pulse ESP applied to the Y electrode line Y will be described in detail below. First, high pulses having desired periods T8 and T9 as shown in (f) and (g) of FIG. 5 are applied to the fifth and sixth switching devices Q5 and Q6, respectively. The fifth and sixth switching devices Q5 and Q6 are turned on in response to these high pulses. The first and second switching devices Q1 and Q2 are alternately turned on at a state of turning on the fifth and sixth switching devices Q5 and Q6. Thereafter, the first and second switching devices Q1 and Q2 are alternately turned on with having timing synchronized with the address pulse. If the second switching device Q2 is turned on, then the Y electrode line Y remains at the middle voltage VM. If the first switching device Q1 is turned on, then the middle voltage VM applied to the Y electrode line Y is superposed with the voltage VP of the erasure pulse ESP accumulated in the first capacitor C1 to be applied to the Y electrode line Y. At this time, the Z electrode line Z remains at the middle voltage VM for the desired periods T8 and T9. On the other hand, the address pulse is synchronized with the erasure pulse ESP and, thus, is not applied to the discharge cell to be turned on. In other words, an erasing discharge is not generated to maintain an emitting discharge in the sustaining interval (not shown). During an erasure period (not shown), an address pulse is applied to the X electrode line X and an erasure pulse synchronized with this address pulse is applied to the Y electrode lines Y1 to Ym to thereby terminate an emitting discharge of the entire discharge cells.

The conventional PDP applies a high level of sustaining pulse, via the switching devices included in the voltage input/output stage, to the panel. At this time, a heat may be generated by a voltage drop according to resistance values of the switching devices included in the voltage input/output stage to damage the switching devices. Large power consumption is caused by resistance values of the switching devices itself. Also, an output voltage of the panel is lowered at the Y electrode line coupled with a large sustaining pulse current. Thus, at the Y electrode line coupled with a large sustaining pulse current, an abnormal brightness allowing a portion corresponding to the electrode area to become dark is generated. Furthermore, the conventional PDP produces the erasing pulse and the writing pulse using a single voltage VP. At this time, to make a voltage level of the writing pulse more than a desired level provides an easy writing. However, the conventional PDP has a problem in that, if an erasing pulse having a voltage more than a desired voltage level is applied, then an erasure is made at a time when an erasure must not be made.

SUMMARY OF THE INVENTION

Accordingly, it is an object of the present invention to provide a separate voltage driving method and apparatus for a plasma display panel that is capable of restraining an abnormal brightness caused by a characteristic deviation of the panel as well as preventing a damage of switching devices caused by an overcurrent.

A further object of the present invention is to provide a separate voltage driving method and apparatus for a plasma display panel that is adapted to separate and adjust a sustaining voltage, a writing voltage and an erasing voltage.

In order to achieve these and other objects of the invention, a separate voltage driving method for a plasma display panel according to one aspect of the present invention uses sub-fields in a frame for a picture display, at least one of which includes a writing discharge interval for separately generating positive and negative sustaining pulses and positive and negative writing pulses having a different desired level and width at first and second electrodes, and for superposing the separated positive and negative sustaining pulses with the positive writing pulse to make a writing discharge of the entire cells; an address interval for separately applying the positive sustaining pulse and the negative sustaining pulse after the writing discharge to sustain a discharge of the entire cells, and for applying a reference voltage to any one electrode of the first and second electrodes while applying a negative erasure scanning pulse having a phase contrary to the address pulse of the address electrode to the other electrode thereof, thereby selectively erasing the writing discharge for the entire cells; and a sustaining discharge interval for separately applying the positive and negative sustaining pulses to the first and second electrodes to sustain the writing discharge for the cells except for the erased cells in the entire cells.

A separate voltage driving apparatus for a plasma display panel according to another aspect of the present invention includes writing voltage generating means for generating a writing pulse having a voltage level and a pulse width required for a discharge of the entire cells between first and second electrodes; sustaining voltage generating means for generating pulses, each of which has a voltage level and a pulse width required for sustaining the writing discharge of the entire cells between the first and second electrodes, having a phase contrary to each other; erasure scanning voltage generating means for generating a pulse having a voltage level required for making an erasure scanning of at least selected cells in the entire cells between the first and second electrodes; voltage recovering means for recovering an invalid power from the panel to accumulate it and for discharging the accumulated invalid power upon the writing discharge, the sustaining discharge and the erasure scanning discharge; and voltage input/output means for applying a voltage level of each of said pulses to any one electrode of the first and second electrodes and discharging a voltage from the other electrode thereof.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENT

Figure 1:
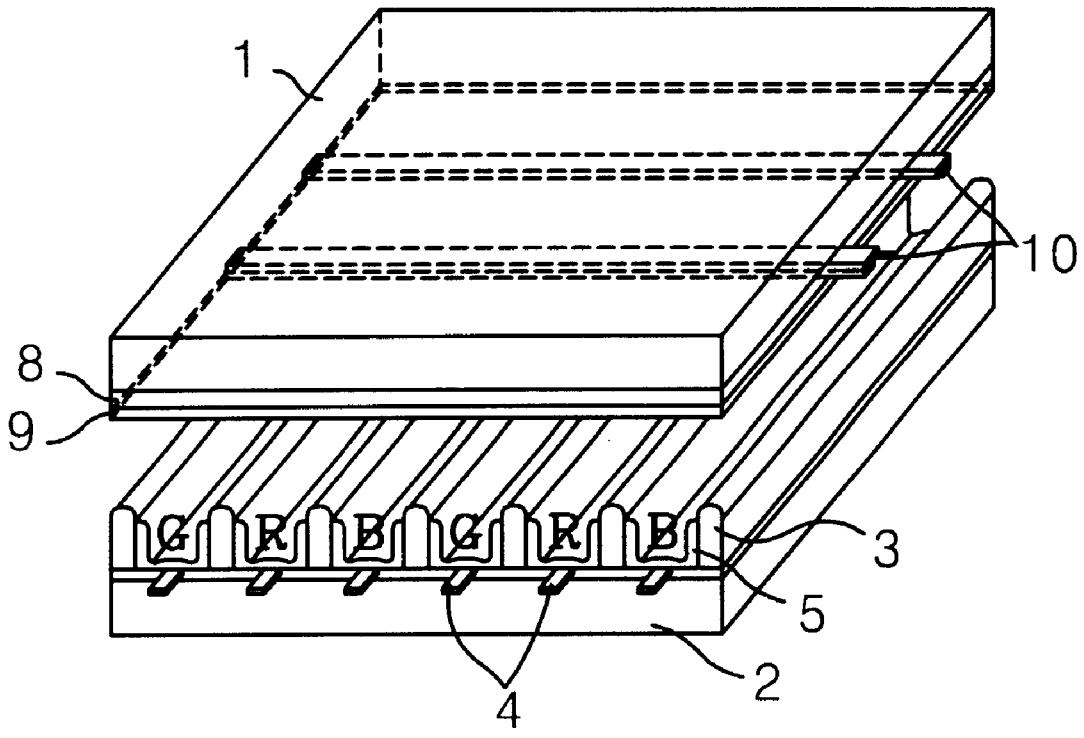
FIG. 1 CONVENTIONAL ART
FIG. 1 is a schematic perspective view showing the structure of a conventional plasma display panel.
Figure 2:
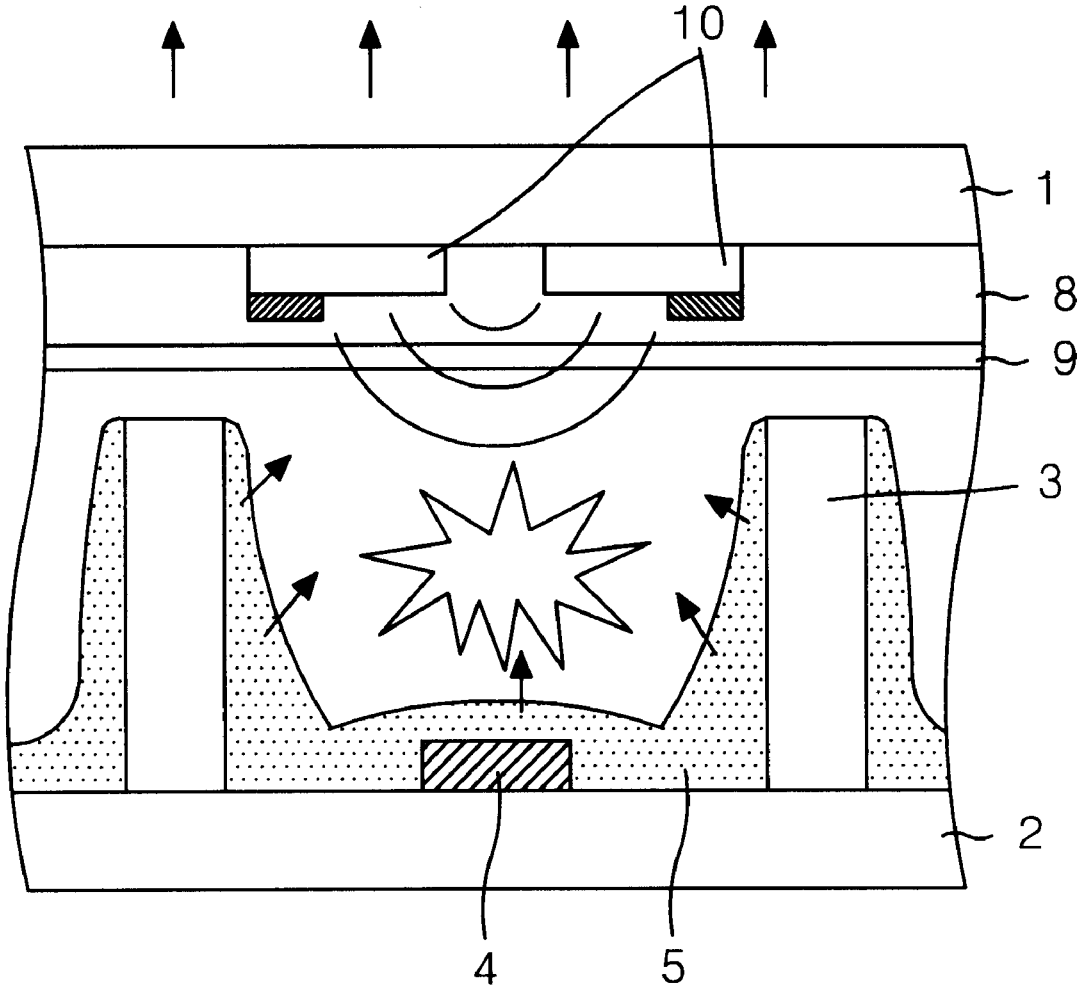
FIG.2 CONVENTIONAL ART
FIG. 2 is a section view showing a discharge cell structure of the plasma display panel in FIG. 1.
Figure 3:
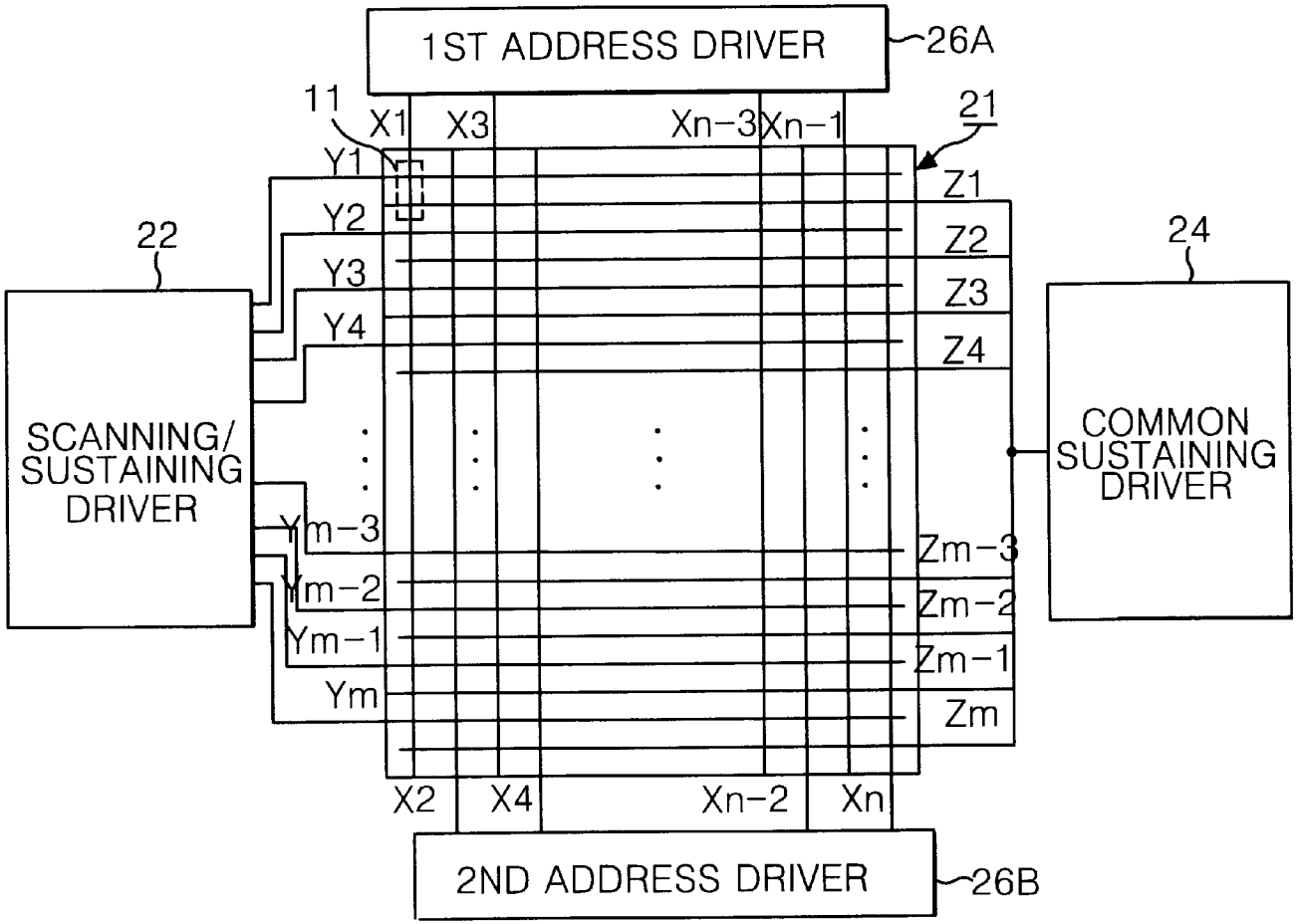
FIG.3 CONVENTIONAL ART
FIG. 3 is a plan view showing an entire arrangement of the electrode lines and the discharge cell of the plasma display panel in FIG. 1.
Figure 4:
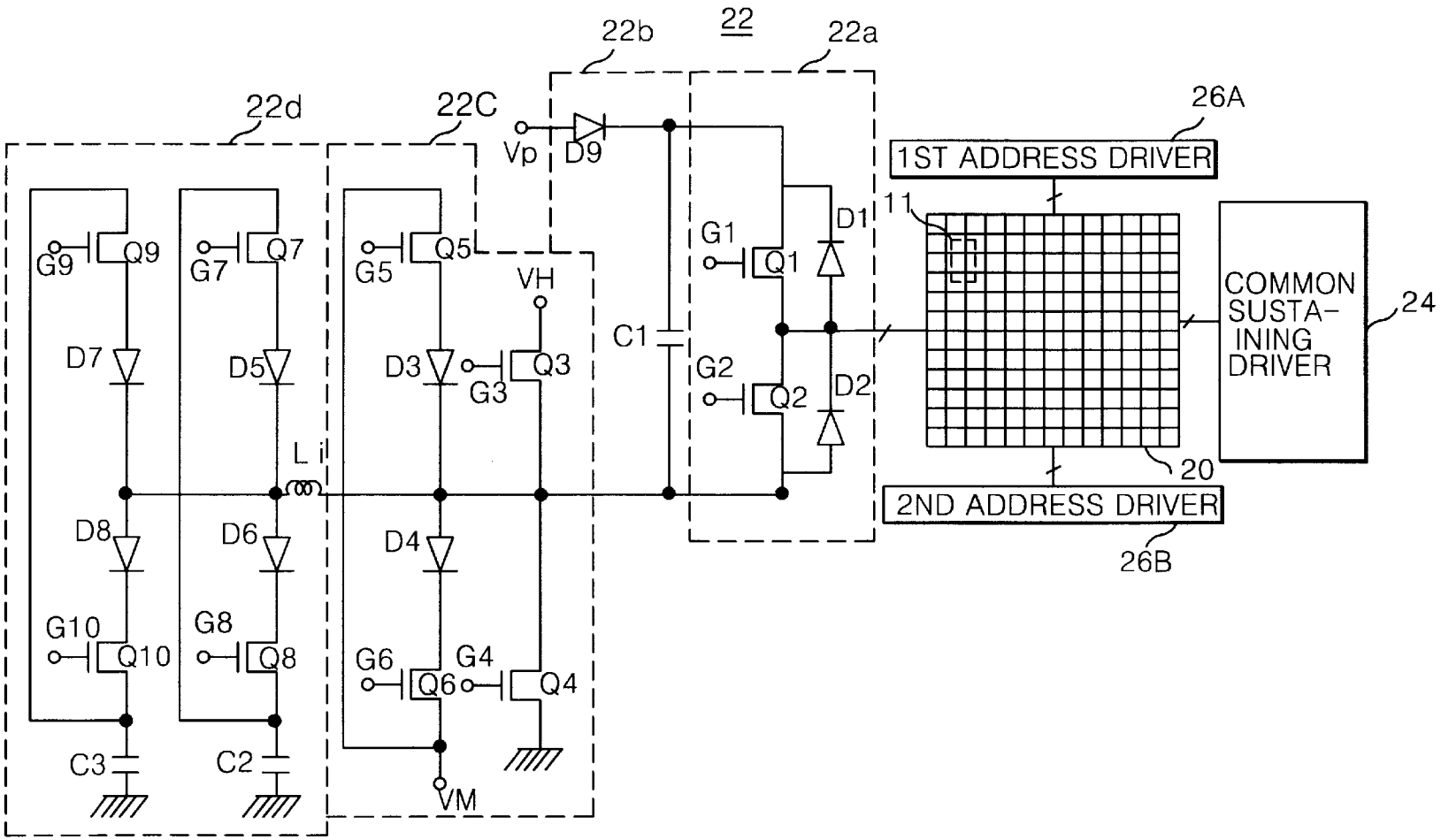
FIG. 4 CONVENTIONAL ART
FIG. 4 is a detailed circuit diagram of the scanning/sustaining driver shown in FIG. 3.
Figure 5:
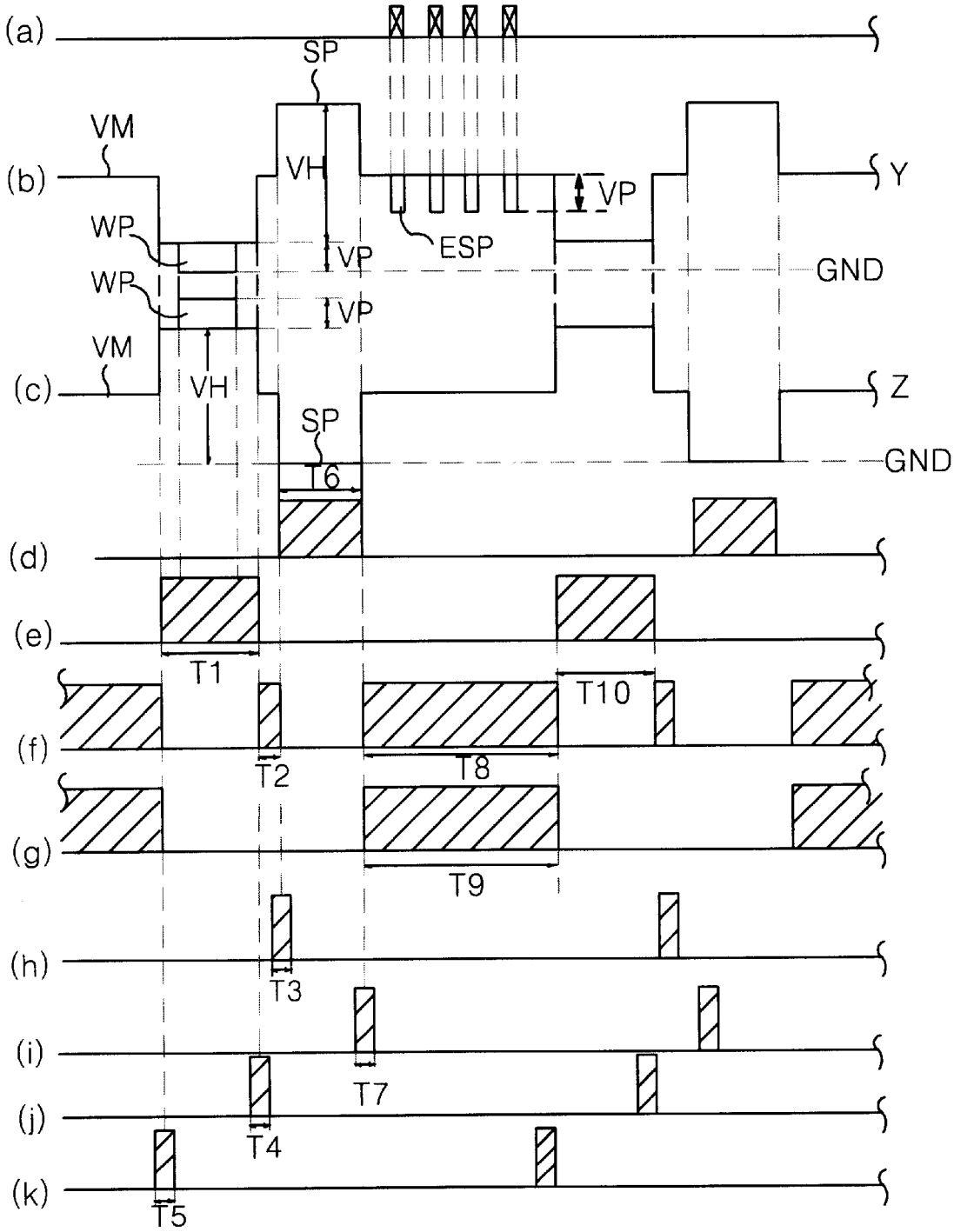
FIG.5 CONVENTIONAL ART
FIG. 5 represents a voltage waveform generated from the scanning/sustaining driver shown in FIG. 4 and an operational timing of the switching devices included in the scanning/sustaining driver.
Figure 6:
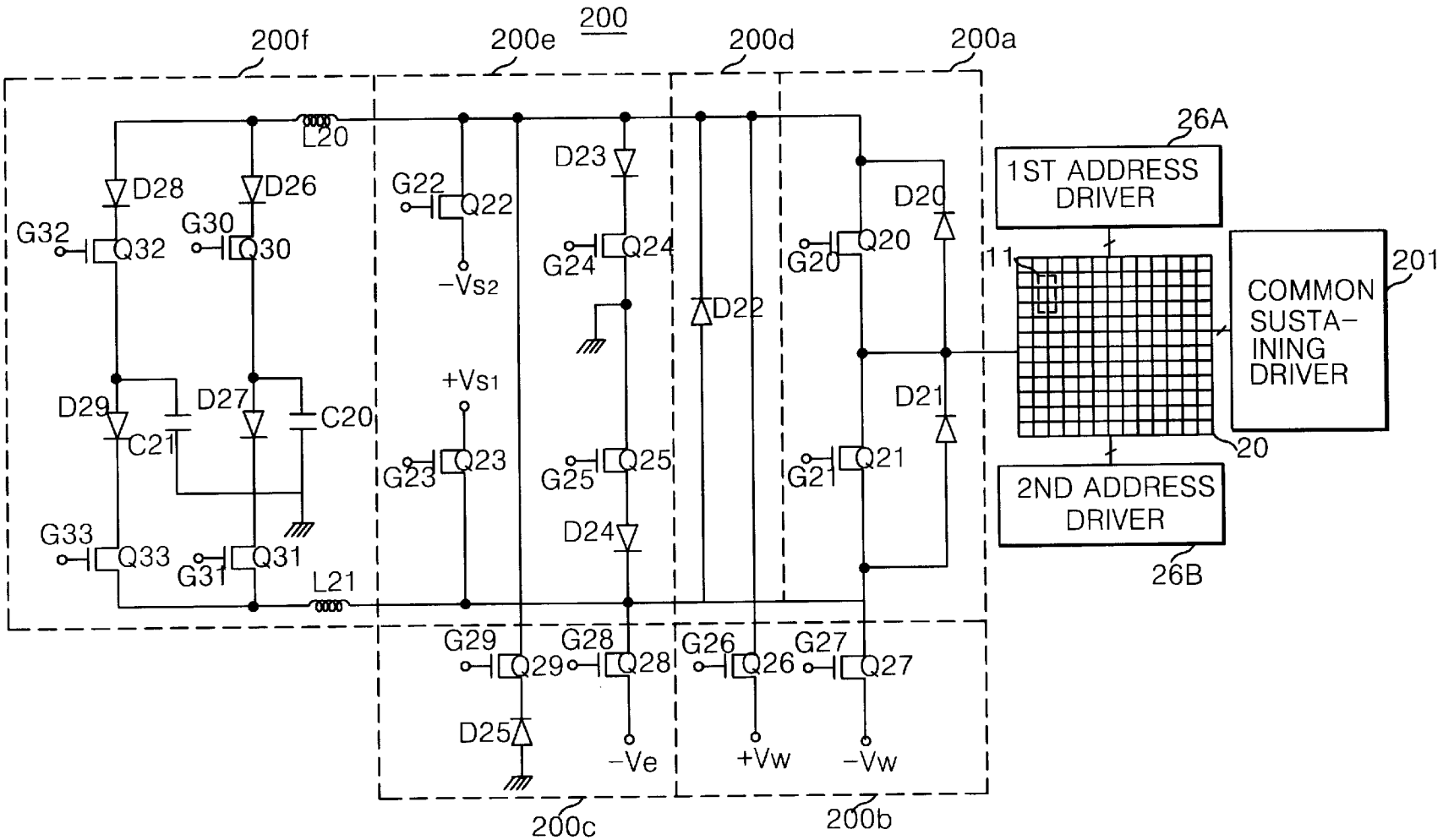
FIG. 6 is a detailed circuit diagram showing the configuration of a scanning/sustaining driver according to an embodiment of the present invention.

Referring to FIG. 6, there is shown a driving apparatus for a plasma display panel according to an embodiment of the present invention. The driving apparatus includes a scanning/sustaining driver 200 for individually applying a sustaining voltage, a writing voltage and an erasing voltage to Y electrode lines Y1 to Ym at the row side thereof, a common sustaining driver 201 for individually applying a sustaining voltage, a writing voltage and an erasing voltage, which have a phase contrary to a voltage of a pulse applied to the Y electrode lines Y1 to Ym and are synchronized with each other, to Z electrode lines Z1 to Zm at the column side thereof, and first and second address drivers 26A and 26B for applying an address pulse to X electrode lines X1 to Xn crossing the Y electrode lines Y1 to Ym and the Z electrode lines Z1 to Zm perpendicularly to form a cell 11.

As shown in FIG. 6, the scanning/sustaining driver 200 includes a voltage input/output stage 200*a*, a writing voltage generator 200*b*, an erasing voltage generator 200*c*, a voltage balancing stage 200*d*, a sustaining voltage generator 200*e* and a voltage recovering stage 200*f* so as to apply a driving pulse to any one of the m Y electrode lines Y1 to Ym. The voltage input/output stage 200*a* consists of switching devices Q20 and Q21 connected, in series, to each other, and diodes D20 and D21 connected, in parallel, to the switching devices Q20 and Q21. The switching devices Q20 and Q21 are selectively switched in response to a control signal applied from a controller (not shown). Thus, positive and negative writing pulse voltages $+V_w$ and $-V_w$, positive and negative sustaining pulse voltages $+V_{s1}$ and $-V_{s2}$, a ground voltage GND and a negative erasing pulse voltage $-V_e$ are applied to the pixel cell 11 of the panel 20. The positive and negative sustaining pulse voltages $+V_{s1}$ and $-V_{s2}$ can become same or different from each other in absolute value. The voltage input/output stage 200*a* makes a loop for sustaining discharge, writing discharge and erasing discharge voltages applied from the common sustaining driver 201 to drive the corresponding cell 11. The writing voltage generator 200*b* consists of switching devices Q26 and Q27 connected, in series, to the switching devices Q20 and Q21, respectively. Source terminals of the switching devices Q26 and Q27 are connected to negative and positive voltage ($+V_w$ and $V_w$) terminals, respectively. The switching devices Q26 and Q27 are selectively switched in response to a control signal from the controller to apply the positive and negative writing voltages $+V_w$ and $V_w$ to the voltage input/output stage 200*a*, respectively. The sustaining voltage generator 200*e* consists of switching devices Q22 and Q23 connected, in series, to the switching devices Q20 and Q21, respectively, and switching devices Q24 and Q25 and diodes D23 and D24 connected, in parallel, to the switching devices Q20 and Q21. A source terminal of the switching device Q25 is coupled with a positive sustaining voltage $+V_{s1}$ while a source terminal of the switching device Q26 is coupled with a negative sustaining voltage $-V_{s2}$. The switching devices Q24 and Q25 are selectively switched in response to a control signal from the controller to apply a sustaining voltage with a ground potential GND to the voltage input/output stage 200*a* and to couple a sustaining discharge voltage outputted from the panel 20 with the ground potential GND. The erasing voltage generator 200*c* consists of switching devices Q28 and Q29 connected, in series, to the switching devices Q20 and Q21, respectively, and a diode D25. A source terminal of the switching device Q28 is connected to a negative erasing voltage ($+V_e$) terminal while the switching device Q29 is connected, via the diode D25, to the ground terminal GND. The switching devices Q28 and Q29 are simultaneously turned on in response to a control signal from the controller. If the switching devices Q28 and Q29 are turned on, then an erasing voltage remains at the ground potential GND and a negative erasing voltage $-V_e$ is applied to the voltage input/output stage 200*a* at a desired timing. The voltage recovering stage 200*f* includes a first reactor L20 connected, in series, to the switching device Q20, and switching devices Q30, Q31, Q32 and Q33 and diodes D26, D27, D28 and D29 connected, in parallel, between the first reactor L20 and a second reactor L21. The switching devices Q30 and Q32 are selectively switched to recover an invalid power of the panel 20 through the first reactor L20. The invalid power recovered from the panel 20 is accumulated in capacitors C20 and C21 at a different level. The invalid power accumulated in the capacitors C20 and C21 is applied, via the second reactor L21, to the panel 20 upon next discharge. To this end, the switching devices Q31 and Q33 are selectively switched in response to a control signal form the controller. The voltage balancing stage 200*d* includes a diode D22 connected, in parallel, between the switching devices Q20 and Q21. The diode D22 connected, in parallel, between the switching devices Q20 and Q21 maintain the voltages applied to the switching devices Q20 and Q21 in a state of equilibrium.

The common sustaining driver 201 is configured in similarity to the scanning/sustaining driver 200 to apply positive and negative sustaining voltages, writing voltages and erasing voltages to the Z electrode lines Z1 to Zm.

Figure 7:
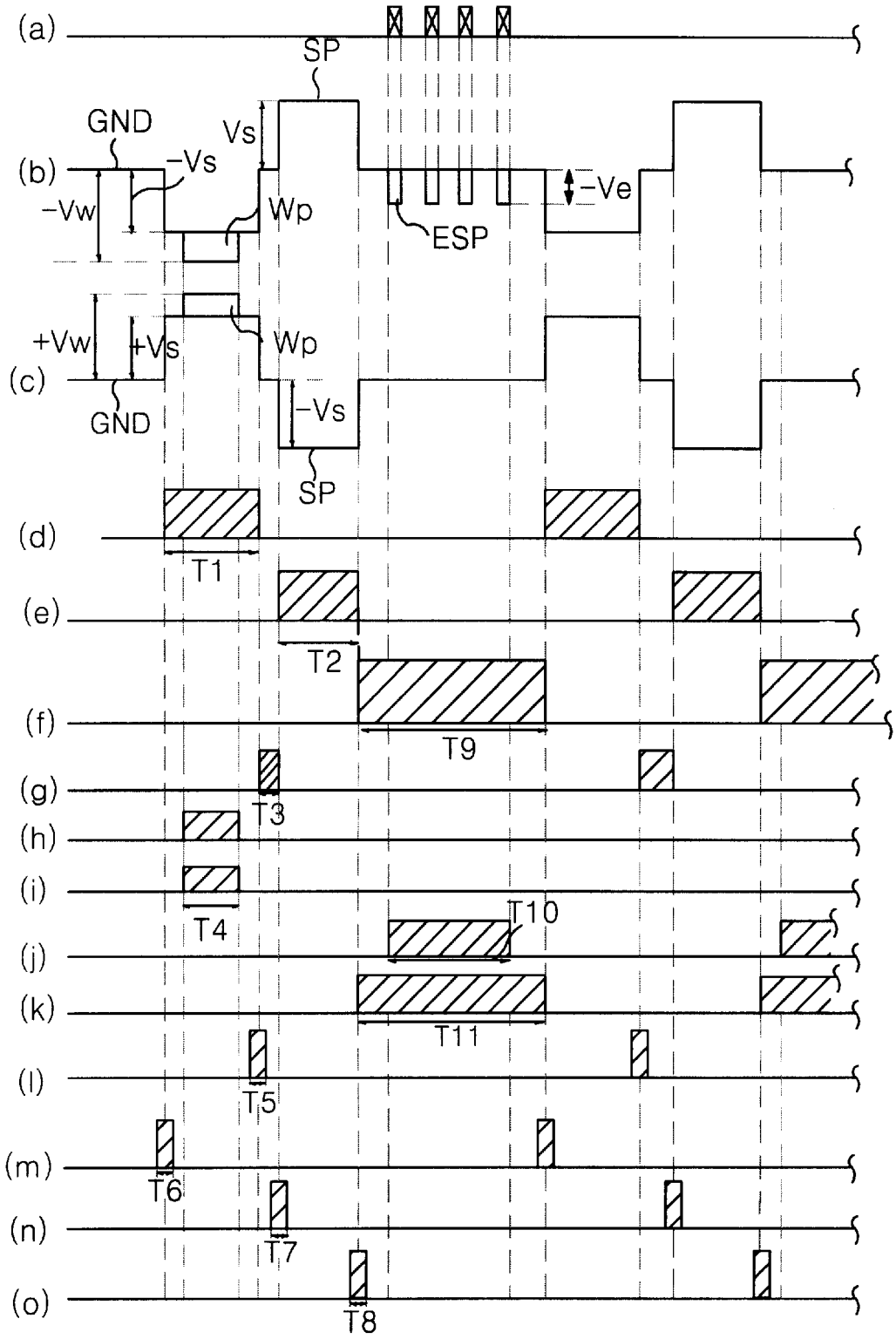
FIG. 7 represents a voltage waveform generated from the scanning/sustaining driver shown in FIG. 6 and an operational timing of the switching devices included in the scanning/sustaining driver.

FIG. 7 represents a switching timing of the scanning/sustaining driver shown in FIG. 6 and a voltage waveform generated at this switching timing, in which (a) represents a waveform applied to the X electrode lines; (b) represents a waveform applied to the Y electrode lines; (c) does a waveform applied to the Z electrode lines; (d) to (o) do a waveform applied to the switching devices of the scanning/sustaining driver to produce a voltage waveform of (c). An operation process of the scanning/sustaining driver 200 will be described in detail with reference to FIG. 7.

First, a high pulse having a certain period as shown in (f) of FIG. 7 is applied to the switching device Q24 in a sustaining discharge interval of the previous sub-field at one frame. The switching device Q24 is turned on in response to this high pulse. At the same time, a high pulse having a certain period as shown in (k) of FIG. 7 is applied to a gate terminal G29 of the switching device Q29. The switching device Q29 is turned on in response to this high pulse. If the switching device Q29 is turned on, then a ground terminal GND is connected, via the diode D25, the switching device Q29 and the switching device Q20, to the Y electrode line Y of the panel 20. If the switching device Q24 is turned on, then the common sustaining driver 201 is connected, via the diode D20, the diode D23 and the switching device Q24, to the ground terminal GND. In other words, if the switching devices Q24 and Q29 are turned on, then the Y electrode line Y and the Z electrode line Z remain at the ground potential GND as shown in (b) and (c) of FIG. 7. The Y electrode line Y and the Z electrode line Z remain at a reference voltage until the switching devices Q24 and Q29 are turned off. On the other hand, a high pulse having a desired period T6 as shown in (m) of FIG. 7 is applied to a gate terminal G31 of the switching device Q31 before the switching devices Q24 and Q29 are turned off. The switching device Q31 is turned on in response to this high pulse. If the switching device Q31 is turned on, then a middle voltage of a positive sustaining voltage $+V_{s1}$ having been accumulated in the first capacitor C20, that is, a middle voltage having a level of $+V_{s1}/2$ is discharged at the previous sub-field. The voltage discharged from the first capacitor C20 is accumulated, via the diode D27, the switching device Q31, the second reactor L21 and the diode D21, into the panel capacitor. When the middle voltage has been accumulated in the panel capacitor, the switching device Q24 and Q29 are turned off. After the middle voltage was accumulated in the panel capacitor, a high pulse having a desired period T1 as shown in (d) of FIG. 7 is applied to the gate terminal G22 of the switching device Q22. The switching device Q22 is turned on in response to this high pulse. If the switching device Q22 is turned on, then a negative sustaining voltage $-V_{s2}$ as shown in (b) of FIG. 7 is applied to the Y electrode line Y. At this time, the Y electrode line Y obtains a negative sustaining pulse SP less than a reference potential as shown in (b) of FIG. 7. Herein, the reference potential is a reference level for the positive sustaining voltage $+V_{s1}$ and the negative sustaining pulse $-V_{s2}$, which is a ground voltage GND of 0V.

A high pulse having a desired period T4 as shown in (i) of FIG. 7 is applied to a gate terminal G27 of the switching device Q27 in a state at which the Y electrode line Y maintains the negative sustaining pulse $-V_{s2}$. The switching device Q27 is turned on in response to this high pulse. If the switching device Q27 is turned on, then a negative writing voltage $-V_w$ is applied to the Y electrode line Y. As a result, a writing pulse WP having a voltage level lower than the negative sustaining voltage $-V_{s2}$ as shown in (b) of FIG. 7 is applied to the Y electrode line Y. After the writing pulse WP was applied to the Y electrode line Y, the switching device Q27 is cut off. After the switching device Q27 was cut off, a high pulse having a desired period T5 as shown in (l) of FIG. 7 is applied to a gate terminal G30 of the switching device Q30. The switching device Q30 is turned on in response to this high pulse. If the switching device Q30 is turned on, then a positive sustaining voltage $+V_{s1}$ applied from the common sustaining driver 201 is accumulated, via the diode D20, the first reactor L20 and the diode D26, into the first capacitor C20. At this time, a voltage of $+V_{s1}/2$ is accumulated in the first capacitor C20. On the other hand, the common sustaining driver 201 applies a voltage as shown in (c) of FIG. 7, which is synchronized with and has a phase contrary to the pulse applied to the Y electrode line Y, to the Z electrode line Z. In other words, the positive sustaining pulse voltage $+V_{s1}$ plus the writing pulse (WP) voltage is applied to the Z electrode line Z.

A process of applying the positive sustaining pulse voltage $+V_{s1}$ to the Z electrode line will be described in detail below. When the switching devices Q22 and Q27 included in the scanning/sustaining driver 200 are turned on at a timing as described earlier, the switching devices Q23 and Q26 included in the common sustaining driver 201 are turned on for the desired periods T1 and T4. If the switching device Q23 is turned on, then a positive sustaining voltage $+V_{s1}$ is applied, via the diode D21, to the Z electrode line Z. Thereafter, the switching device Q26 is turned on to apply a positive writing voltage $+V_w$ to the Z electrode line Z. In other words, a writing voltage $+V_w$ larger than the sustaining voltage $+V_{s1}$ is applied to the Z electrode line Z. Thus, a positive sustaining pulse and a writing pulse as shown in (c) of FIG. 7 are applied to the Z electrode line Z.

The positive and negative sustaining voltage $+V_{s1}$ and $-V_{s2}$ applied form the scanning/sustaining driver 200 and the common sustaining driver 201 are applied, via the diodes D20 and D21, to the Y or Z electrode line Y or Z. Further, The positive and negative writing voltage $+V_w$ and $-V_w$ applied form the scanning/sustaining driver 200 and the common sustaining driver 201 are applied, via the switching devices Q20 and Q21, to the Y or Z electrode line Y or Z. In other words, the switching devices Q20 and Q21 does not generate a voltage drop caused by a high sustaining discharge current.

As described above, if the writing pulses WP, which are synchronized with and has a contrary phase to each other as shown in (b) and (c) of FIG. 7, are applied to the Y and Z electrode lines Y and Z, then a discharge is initiated by a voltage difference 2WP of two writing pulse. At this time, a positive(+) polarity of wall charges are formed at the Y electrode line Y while a negative(−) polarity of wall charges are formed at the Z electrode line Z. Since such a writing discharge is influenced by the previous field state of the discharge cell, it becomes unstable. Accordingly, in order to provide a stable discharge of all the cells, positive and negative sustaining pulses SP, which are synchronized with and has a phase contrary to each other as shown in (b) and (c) of FIG. 7, must be applied to the Y and Z electrode lines Y and Z in the address interval.

A process of producing the sustaining pulse SP will be described in detail below. First, the switching device Q22 is turned off in a state at which a value of $+V_{s1}$ has been accumulated in the first capacitor C20. Thereafter, a high pulse having a desired period T3 as shown in (g) of FIG. 7 is applied to a gate terminal G25 of the switching device Q25. The switching device Q25 is turned on in response to this high pulse. If the switching device Q25 is turned on, then a ground voltage GND of 0V is applied, via the diodes D24 and D21, to the panel capacitor of the panel. Thus, a negative sustaining voltage $-V_{s2}$ maintains a ground voltage GND at the Y electrode line Y during a desired period T3 as shown in (b) of FIG. 7. At this time, a high pulse having a desired period T7 as shown in (n) of FIG. 7 is applied to a gate terminal G32 of the switching device Q32. The switching device Q32 is turned on in response to this high pulse. If the switching device Q32 is turned on, then a negative sustaining voltage $-V_{s2}$ discharged from the panel capacitor is accumulated, via the diode D20, the first reactor L20, and the diode D28 and the switching device Q32, into the second capacitor C21. At this time, a voltage of $-V_{s2}/2$ is accumulated in the second capacitor C21. After the switching device Q25 was cut off, a high pulse is applied to a gate terminal G23 of the switching device Q23. The switching device Q23 is turned on in response to this high pulse. If the switching device Q23 is turned on, then a positive sustaining voltage $+V_{s1}$ is applied, via the diode D21, to the Y electrode line Y. Thus, a sustaining pulse having a higher potential than the ground voltage GND as shown in (b) of FIG. 7, that is, a positive sustaining pulse SP is applied to the Y electrode line Y.

On the other hand, the common sustaining driver 201 applies a negative sustaining pulse SP being synchronized with and having a phase contrary to the positive sustaining pulse SP applied to the Y electrode line Y as shown in (c) of FIG. 7 to the Z electrode line Z.

A process of applying the negative sustaining pulse SP to the Z electrode line Z will be described in detail below. First, when the switching device Q23 included in the scanning/sustaining driver 200 is turned on, the switching device Q22 included in the common sustaining driver 201. If the switching device Q22 is turned on, then the Z electrode line Z is connected, via the diode D20 and the switching device Q22, to the ground terminal GND. As a result, a negative sustaining pulse SP having a voltage level lower than the ground potential GND as shown in (c) of FIG. 7 is applied to the Z electrode line Z.

If the positive and negative sustaining pulses SP having a contrary phase to and being synchronized with each other as described above are applied to the Y and Z electrode lines Y and Z, then an electric field forming wall charges at the panel 20 is superposed with an applying electric field. Thus, a sustaining discharge is caused by a sustaining voltage difference 2SP between two electrodes lower than the discharge initiating voltage. Accordingly, a writing discharge becomes stable and wall charges are formed at a constant level. At this time, a negative(−) polarity of wall charges are formed at the Y electrode line Y while a positive(+) polarity of wall charges are formed at the Z electrode line. When a sustain discharge is generated at the discharge cell, a high pulse having a desired period T8 as shown in (o) of FIG. 7 is applied to a gate terminal G33 of the switching device Q33. The switching device Q33 is turned on in response to this high pulse. If the switching device Q33 is turned on, then a voltage of $-V_{s2}/2$ accumulated in the second capacitor C21 is discharged. The voltage discharged from the second capacitor C21 is applied, via the diode D29, the switching device Q33, the second reactor L21 and the diode D21, to the Y electrode line Y. Accordingly, the Y electrode line Y remains at a voltage of $(-V_{s2}/2)+(+V_s)$, which is a difference between a voltage of $-V_{s2}/2$ discharged from the second capacitor C21 for a desired period T8 and a voltage of $+V_{s1}$ applied for a T2 period. The switching device Q23 is turned off in a state at which the Y electrode line Y remains at a voltage of $(-V_{s2}/2)+(+V_{s1})$. After the switching device Q23 was turned off, high pulses having desired periods T9 and T11 as shown in (f) and (k) of FIG. 7 are applied to gate terminals G24 and G29 of the switching devices Q24 and Q29, respectively. The switching devices Q24 and Q29 are turned on in response to these high pulses. If the switching devices Q24 and Q29 are turned on, then the Y electrode line Y is connected to the ground terminal GND as shown in (b) of FIG. 7. In other words, a voltage of $(-V_{s2}/2)+(+V_{s1})$ having been applied to the Y electrode line Y is bypassed via the diode D20, the diode D23 and the switching device Q24. Thus, a sustaining pulse having a ground potential GND as shown in (b) of FIG. 7 is applied to the Y electrode line Y. Also, the ground voltage GND is applied, via the diode D25, the switching device Q29 and the switching device Q20, to the Y electrode line Y during the T11 period.

At this time, a positive address pulse as shown in (a) of FIG. 7 is applied to the X electrode line X of the cell to be turned off. An erasing pulse ESP as shown in (b) of FIG. 7 is synchronized with this address pulse to be applied to the Y electrode line Y during the T10 period. A certain cell arranged in a matrix type can be selected with the aid of the erasing pulse ESP applied to the Y electrode line Y and the address pulse applied to the X electrode line X. If the erasing pulse ESP is applied to the Y electrode line Y, then it is insufficient for a sum of an electric field caused by charged particles of the panel 20 and an electric field caused by two pulses to sustain a discharge continuously. In other words, an erasing discharge is generated at the discharge cell coupled with the erasing pulse ESP and the address pulse. Accordingly, a wall voltage remains at a ground potential to terminate an emitting discharge.

More specifically, since the Y electrode line Y has been set to less than the discharge initiating voltage, an erasing discharge is generated at the cell coupled with both the erasing pulse ESP and the address pulse. At this time, the Z electrode line Z remains at a ground potential GND as shown in (c) of FIG. 7. Accordingly, even though the address pulse is applied to the X electrode line X, the Z electrode line Z is not discharged.

A process of producing the erasing pulse ESP applied to the Y electrode line Y will be described in detail below. First, high pulses having desired periods T10 and T11 as shown in (j) and (k) of FIG. 7 are applied to the switching devices Q29 and Q28. The switching devices Q29 and Q28 are turned on in response to these high pulse signals. After the switching devices Q29 and Q28 were turned on, the switching devices Q20 and Q21 are alternately turned on. At this time, the switching devices Q20 and Q21 are turned on at a timing synchronized with the address pulse.

If the switching device Q21 is turned on, then an erasure scanning voltage $-V_e$ is applied, via the switching device Q28 and the switching device Q21, to the Y electrode line. In other words, a voltage $-V_e$ of the erasing pulse ESP is applied to the Y electrode line Y. If the switching device Q20 is turned on, then a ground potential GND is applied, via the diode D25, the switching device Q29 and the switching device Q20, to the Y electrode line Y. In other words, the Y electrode line Y remains at a ground potential GND. At this time, the common sustaining driver 201 is coupled with a ground potential GND during the desired period T9 as shown in (c) of FIG. 7. In other words, the Z electrode line Z remains at a ground potential GND.

In this manner, a negative erasing pulse ESP being synchronized with and having a phase contrary to the address pulse during the T10 period as shown in (c) of FIG. 7 is produced. The negative erasing pulse ESP is applied to the Y electrode line Y of the discharge cell. The address pulse is not applied to the X electrode line X of the discharge cell to be turned on. In other words, an erasing discharge is not generated to sustain an emitting discharge in the sustaining interval (not shown). The address pulse is applied to the X electrode line X during the erasure period (not shown) and the erasing pulse synchronized with the address pulse is applied to the Y electrode lines Y1 to Ym, thereby terminating an emitting discharge of the entire discharge cells.

In the conventional drivers 22 and 24 compared with the present drivers, the conventional scanning/sustaining driver 22 and common sustaining driver 24 has used a single voltage source so as to produce a writing voltage and an erasing voltage. Also, a high sustaining discharge current has been applied, via the switching devices of the voltage input/output stage, to the panel. On the other hand, the scanning/sustaining driver 200 and the common sustaining driver 201 according to the present invention separates a writing voltage, an erasing voltage and positive and negative sustaining voltages to apply them to the panel. In other words, separating a writing voltage, an erasing voltage and positive and negative sustaining voltages to apply them to the panel permits a voltage adjustment according to a characteristic of the panel. Also, a high sustaining discharge current is applied, via the diodes, to the panel to reduce a voltage drop. In other words, an abnormal brightness can not be generated to obtain a stable resolution for the entire screen.

As described above, according to the present invention, the sustaining discharge current is applied, via the diodes of the voltage input/output stage, to the panel to prevent the generation of abnormal brightness. Also, a writing voltage, an erasure scanning voltage and positive and negative sustaining voltages are separated and applied, so that it becomes possible to provide a voltage adjustment into a desired level in accordance with a characteristic of the panel. By this voltage separation, a panel having a poor characteristic also can be easily driven.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A separate voltage driving method for a plasma display panel in which a writing pulse, a sustaining pulse and an erasure scanning pulse are separately applied to the panel including a plurality of first and second electrodes covered with a dielectric material, and address electrodes crossing the first and second electrodes to form cells so as to drive the panel, wherein at least one of sub-fields in a frame for a picture display comprises:

a writing discharge interval for separately generating positive and negative sustaining pulses and positive and negative writing pulses having a different desired level and width at the first and second electrodes, and for superposing the separated positive and negative sustaining pulses with the positive writing pulse to make a writing discharge of the entire cells;

an address interval for separately applying the positive sustaining pulse and the negative sustaining pulse after the writing discharge to sustain a discharge of the entire cells, and for applying a reference voltage to any one electrode of the first and second electrodes while applying a negative erasure scanning pulse having a phase contrary to the address pulse of the address electrode to the other electrode thereof, thereby selectively erasing the writing discharge for the entire cells; and a sustaining discharge interval for separately applying the positive and negative sustaining pulses to the first and second electrodes to sustain the writing discharge for the cells except for the erased cells in the entire cells.

2. The method as claimed in claim 1, wherein the positive and negative writing pulses remain at the same level to be applied to the first and second electrodes in the writing discharge interval.

3. The method as claimed in claim 1, wherein the positive and negative sustaining pulses remain at the same level to be applied to the first and second electrodes in the address interval.

4. The method as claimed in claim 3, wherein the positive and negative sustaining pulses and the positive and negative writing pulses are simultaneously applied to the entire cells of the panel.

5. The method as claimed in claim 1, wherein the writing pulse and the sustaining pulse are separated into a positive polarity of pulse and a negative polarity of pulse for the one sub-field to apply them to any one of the first and second electrode.

6. A separate voltage driving apparatus for a plasma display panel in which a writing pulse, a sustaining pulse and an erasure scanning pulse are separately applied to the panel including a plurality of first and second electrodes covered with a dielectric material, and address electrodes crossing the first and second electrodes to form cells so as to drive the panel, wherein any one of first and second sustaining drivers comprises:

writing voltage generating means for generating a writing pulse having a voltage level and a pulse width required for a discharge of the entire cells between the first and second electrodes;

sustaining voltage generating means for generating pulses, each of which has a voltage level and a pulse width required for sustaining the writing discharge of the entire cells between the first and second electrodes, having a phase contrary to each other;

erasure scanning voltage generating means for generating a pulse having a voltage level required for making an erasure scanning of at least selected cells in the entire cells between the first and second electrodes;

voltage recovering means for recovering an invalid power from the panel to accumulate it and for discharging the accumulated invalid power upon the writing discharge, the sustaining discharge and the erasure scanning discharge; and voltage input/output means for applying a voltage level of each of said pulses to any one electrode of the first and second electrodes and discharging a voltage from the other electrode thereof.

7. The separate voltage driving apparatus as claimed in claim 6, the erasure scanning voltage generating means allows a sustain current to be flowed through a diode therein.

8. The separate voltage driving apparatus as claimed in claim 6, wherein the voltage input/output means comprises:

a plurality of switching devices, being connected, in series, to each other to be selectively driven, for applying the separated erasure scanning pulse and writing pulse to any one of the first and second electrodes of said panel at a desired timing at a connection node therebetween and for making a loop for a discharge voltage from the panel; and a plurality of diodes, being connected, in parallel, to the plurality of switching devices, for applying the sustaining pulse to any one of the first and second electrodes of the panel.

9. The separate voltage driving apparatus as claimed in claim 6, further comprising:

voltage balancing means for maintaining a level of each side voltage of the voltage input/output means in a state of equilibrium.

10. The separate voltage driving apparatus as claimed in claim 9, wherein the voltage balancing means is configured by connecting the diodes to each terminal of the voltage input/output means in parallel.

11. The separate voltage driving apparatus as claimed in claim 6, wherein the writing voltage generating means generates a positive writing pulse and a negative writing pulse having a phase contrary to each other separately during a desired period to apply them to the voltage input/output means.

12. The separate voltage driving apparatus as claimed in claim 11, wherein the positive and negative writing pulses are simultaneously generated during the same period to be applied to the voltage input/output means.

13. The separate voltage driving apparatus as claimed in claim 6, wherein the sustaining voltage generating means separates a positive sustaining pulse and a negative sustaining pulse having a phase contrary to each other during a desired period to selectively apply them to the voltage input/output means.

14. The separate voltage driving apparatus as claimed in claim 6, wherein the erasure scanning voltage generating means remains at a ground level during the desired period to generate a superposed negative erasure scanning pulse having a level lower than the ground level.

* * * * *